US010738426B2

(12) United States Patent
Messelis

(10) Patent No.: US 10,738,426 B2
(45) Date of Patent: Aug. 11, 2020

(54) GATE AND SECURITY BARRIER COMPRISING A GATE

(71) Applicant: GUARDIAR EUROPE, Zwevegem (BE)

(72) Inventor: Timothy Messelis, Lauwe (BE)

(73) Assignee: GUARDIAR EUROPE (BE)

( * ) Notice: Subject to any disclaimer, the term of this patent is extended or adjusted under 35 U.S.C. 154(b) by 172 days.

(21) Appl. No.: 16/095,689

(22) PCT Filed: Apr. 20, 2016

(86) PCT No.: PCT/IB2016/052237
§ 371 (c)(1),
(2) Date: Oct. 22, 2018

(87) PCT Pub. No.: WO2017/182842
PCT Pub. Date: Oct. 26, 2017

(65) Prior Publication Data

US 2019/0127933 A1 May 2, 2019

(51) Int. Cl.
*E01F 13/06* (2006.01)
*E01F 13/12* (2006.01)

(52) U.S. Cl.
CPC ..... *E01F 13/06* (2013.01); *E01F 13/12* (2013.01)

(58) Field of Classification Search
CPC ..... E01F 15/088; E01F 15/00; E01F 15/146; E01F 15/145; E01F 15/143; E01F 13/06; E01F 13/12
See application file for complete search history.

(56) References Cited

U.S. PATENT DOCUMENTS 1,412,769 A * 4/1922 Barnes ..... E06B 11/02 40/606.03
1,631,416 A * 6/1927 Howard ..... E01F 13/06 49/358
4,752,152 A * 6/1988 Crisp ..... E01F 13/123 404/6
4,916,859 A * 4/1990 Butler ..... E01F 13/12 49/9
5,775,675 A * 7/1998 Sicking ..... E01F 15/0476 256/13.1

(Continued)

FOREIGN PATENT DOCUMENTS

WO WO 2005/056927 A1 6/2005
WO WO 2014/005176 A1 1/2014

OTHER PUBLICATIONS

International Search Report and Written Opinion dated Sep. 6, 2016.

*Primary Examiner* — Abigail A Risic
(74) *Attorney, Agent, or Firm* — Fresh IP PLC; Aubrey Y Chen

(57) ABSTRACT

Security barrier comprising at least one barrier structure (10) and at least one gate (1), wherein the barrier structure (10) comprises one or more bottom panels (20) and the gate (1) forms a closable passage through the security barrier and wherein the gate (1) comprises at least one base element (2), wherein in installed state of the security barrier one or more of said one or more bottom panels (20) rest upon the at least one base element (2), such that the gate (1) is at least partly held in place by the barrier structure (10) and gate (1) for a such security barrier.

15 Claims, 8 Drawing Sheets

(56) References Cited

U.S. PATENT DOCUMENTS

| | | | | |
|---|---|---|---|---|
| 7,950,870 | B1 * | 5/2011 | Thompson | E01F 13/12 256/13.1 |
| 8,006,435 | B2 * | 8/2011 | DeBlonk | A63B 71/06 16/369 |
| 9,423,319 | B2 * | 8/2016 | Simon | E01F 15/14 |
| 9,456,581 | B2 * | 10/2016 | Anderson | A01K 3/002 |
| 2001/0014254 | A1 * | 8/2001 | Albritton | E01F 15/146 404/6 |
| 2007/0068079 | A1 * | 3/2007 | Morgan | E01F 13/06 49/49 |
| 2008/0236045 | A1 * | 10/2008 | DeBlonk | G09F 9/33 49/55 |
| 2010/0254759 | A1 * | 10/2010 | Course | E01F 15/025 404/6 |
| 2014/0234024 | A1 * | 8/2014 | Brackin | E01F 13/04 404/6 |
| 2015/0346060 | A1 * | 12/2015 | Simon | E01F 15/145 404/6 |
| 2016/0053449 | A1 * | 2/2016 | Kemper | E01F 13/12 404/6 |
| 2018/0135262 | A1 * | 5/2018 | Stevens | E01F 15/006 |
| 2018/0363258 | A1 * | 12/2018 | Neusch | E01F 13/12 |
| 2019/0071827 | A1 * | 3/2019 | Scott | E01F 15/148 |
| 2020/0056339 | A1 * | 2/2020 | Ball | E01F 13/02 |

* cited by examiner

GATE AND SECURITY BARRIER COMPRISING A GATE

This application is a national stage entry under 35 U.S.C. § 371 of PCT/IB2016/052237 filed Apr. 20, 2016.

FIELD OF THE DISCLOSURE

The present disclosure relates to a security barrier comprising at least one barrier structure and at least one gate, wherein the barrier structure comprises one or more bottom panels and the gate forms a closable passage through the security barrier, and wherein the gate comprises at least one base element.

The present disclosure also relates to a gate, for a security barrier comprising at least one barrier structure with one or more bottom panels, wherein the gate forms a closable passage through the security barrier and comprises at least one base element.

BACKGROUND

Security barriers are used to prevent people, animals etc. from intruding a certain area. Many countries have one or several security barriers for protecting their national borders, in order to prevent people from other countries from immigrating. Also industrial sites, nature reserves, military sites or other areas/grounds are surrounded with security barriers to prevent intrusion of people and animals. These security barriers need to be solid and strong in order to effectively stop potential intruders. They also need to be able to absorb impacts from vehicles such as cars, trucks etc. because people can attempt to destruct a part of the security barrier by crashing into the security barrier with a moving vehicle. Security barriers can be used for temporary, semi-permanent or permanent access protection of areas.

These security barriers often comprise several barrier structures, such as gabions or fence structures and one or several gates such that certain people can access the area when desired. These gates are located between two barrier structures and connected to these barriers structures, such that the security barrier forms one continuous structure.

These gates and the connections between the gates and the barrier structures often form weaker spots in the security barrier, such that potential intruders try to pass the security barrier in the proximity of the gates. To prevent the gate from forming a weaker spot, these gates are sometimes embedded in concrete and/or comprise posts which need to be deeply anchored in the ground. However the installation of such a security barrier is labor intensive and also requires additional material, namely concrete. Security barriers are sometimes placed in remote places where it is difficult to get or to produce concrete. Also the use of deeply anchored posts and concrete does not strengthen the connection between the gate and the barrier structure.

SUMMARY

It is therefore an object of embodiments of the invention to provide a security barrier which comprises at least one gate, wherein said gate does not affect the strength and solidity of the security barrier and wherein said gate does not negatively affect the placement of the security barrier.

This object may be achieved by providing a security barrier comprising at least one barrier structure and at least one gate, wherein the barrier structure comprises one or more bottom panels and the gate forms a closable passage through the security barrier, wherein the gate comprises at least one base element and wherein, in installed state of the security barrier, one or more of said one or more bottom panels rest upon the at least one base element, such that the gate is at least partly held in place by the barrier structure.

Because of this, the weight of a said barrier structure rests at least partly upon the base element of the gate, such that the weight of the barrier structure keeps the gate well in place. A said bottom panel can for example rest entirely upon the base element or can rest partly upon the base element. This security barrier is normally placed upon a ground surface. The base element is here then located between the ground surface and the said one or more bottom panels of the barrier structure.

The barrier structure can for example be a gabion comprising at least bottom panels and front panels or a fence structure comprising at least bottom panels and front panels. These front panels are then preferably provided to extend vertically as such forming a vertical barrier which prevents people from entering the area behind the security barrier. The bottom panels are normally provided to be placed upon a ground surface or, at the level of the base element, upon the base element. The weight of the barrier structure thus partly rests upon the base element, as such holding the gate in place. The gate here is then not necessarily a weaker spot in the security barrier, because the barrier structure can keep the gate well in place when impact forces are exerted upon the security barrier at the level of the gate.

The placement of such a security barrier is easy because one simply places the gate on a ground surface and then places the barrier structure next to the gate, in such a way that the base element of the gate is at least partly covered by one or more bottom panels of the barrier structure. Here it is thus not necessary that parts of the gate are buried and/or need to be embedded in a substance as concrete. However to provide additional strength these last things are still options. When no concrete is used, these security barriers can easily be used for temporary or semi-permanent access protection of areas. Off course they can also be used for permanent access protection of areas.

When the security barrier is installed, the barrier structure preferably extends adjacent to the passage which is formed by the gate, such that the barrier structure does not form an obstacle when the passage is open.

Preferably for every gate there are two said barrier structures which are provided on either side of the gate, wherein one or more bottom panels of both barrier structures are provided to rest upon a said base element of the gate. The gate can comprise for example one base element wherein the one or more bottom panels of each barrier structure rest upon a part of said base element or the gate can comprise for example two base elements wherein the one or more bottom panels of each barrier structure rest upon a respective base element.

The base element can be every element upon which a bottom panel can rest, such as a plate, a panel, one or several bars or rods, etc. The base element preferably has a flat surface upon which a bottom panel can rest. Also the vertical dimensions of the base element in installed state of the security barrier are preferably limited, such that the base element does not hinder the placement of the barrier structure, when the security barrier is provided to be placed upon a ground surface.

In a preferred embodiment the at least one base element is fixed to a said bottom panel which rests upon the base element in installed state of the security barrier. By fixing the base element to one or more bottom panels, a firm connection between the base element and said one or more bottom panels is created, such that forces acting upon the gate or at the level of the connection between the gate and the barrier structure are well absorbed. Here the gate does not form a weaker spot in the security barrier. Preferably each bottom panel which makes direct contact with the base element, in installed state of the security barrier, is fixed to the base element as such ensuring a strong connection.

Further preferably the at least one base element comprises one or several attaching elements to attach the base element to the said bottom panel. The attaching elements can for example comprise bolts and plate elements made of for example steel. The bolts could be placed at the base element of the gate and pass through the bottom panels, the plate elements can then be used to secure the bottom panels of the barrier structure to the base element of the gate. The bottom panels of the barrier structure are then located between the base element and the plate element of the attaching elements.

In a very preferred embodiment the base element comprises a bottom plate, wherein in installed state of the security barrier the said one or more bottom panels rest upon the bottom plate. A plate can be carried out sufficiently thin, such that it does not hinder the placement of the barrier structure partly upon a ground surface and partly upon the said plate. The one or more bottom panels of the barrier structure will here be able to extend substantially parallel to the said ground surface. Also the bottom surface of a plate can be sufficiently large such that a sufficient amount of the gate is located beneath the barrier structure in installed state of the security barrier and the gate is well kept in place. Also plates can be easily manufactured and plates can be easily attached to panels.

Preferably the barrier structure comprises one or more front panels connected to the one or more bottom panels, and the gate comprises at least one front element, connected to the at least one base element, wherein in installed state of the security barrier the at least one front element faces one or more front panels of the barrier structure.

Here the front element of the gate strengthens the gate further as such making the security barrier more apt to absorb impact forces exerted upon it. Because the front element faces one or more front panels, forces acting upon the front element can then also be absorbed by the one or more front panels. The connections between the front element and base element and between the front panels and bottom panels ensure that forces acting upon the security barrier at the height of the gate and at the height of the connection between the gate and the barrier structure, are well guided throughout the security barrier and are well absorbed.

The front element may or may not be directly connected to a said front panel which it faces in installed state of the security barrier.

Also preferably the front element comprises a front plate. A plate can be carried out sufficiently thin, such that it does not form an element which can be easily grasped and/or forms an element which gives sufficient grip to someone who wants to climb the security barrier. Also the dimensions of the plate surface facing said one or more front panels can be sufficiently large such that forces acting upon the gate can be well guided to the barrier structure by the front plate. Also plates can be easily manufactured and plates can be easily attached to panels and other elements.

Preferably if the base element comprises a bottom plate, in installed state of the security barrier, the angle between the bottom plate and the front plate is similar to the angle between the one or more bottom panels and the one or more front panels, such that when the barrier structure is placed upon the bottom plate, the front plate is substantially parallel with respect to the front panels and bottom plate is substantially parallel with respect to the bottom panels. The said angles are preferably both substantially 90°.

In a preferred embodiment the gate comprises one or more movable gate elements which are movable between an open position leaving the said passage through the security barrier open and a closed position closing off the passage. These one or more movable gate elements can for example be movable with the aid of hinges, or they can slide partly in front of the barrier structure to open said passage, etc. Preferably these gate elements comprise a panel which is provided to extend substantially vertically in at least the closed position as such forming a barrier.

Further, at least part of the base element upon which the said one or more bottom panels rest, preferably substantially extends adjacent to the passage. The bottom panels and thus the barrier structure then do not form obstacles for the passage when the gate is in its open position. Also further preferably the security barrier comprises at least two barrier structures with each one or more bottom panels and located on both sides adjacent to the passage. The gate can here be kept in place on its both sides by a barrier structure.

Even more preferably the gate comprises at least two base elements, substantially extending on both sides adjacent to the passage, wherein in installed state of the security barrier one or more of said one or more bottom panels of each barrier structure rest upon a respective base element. If the barrier structures comprise one or more front panels, then the gate preferably also comprises at least two front elements extending on both sides adjacent to the passage.

Further the gate preferably comprises a platform which connects the two base elements. This platform is then preferably provided to rest upon the ground surface on which the security barrier is placed. The platform and the two base elements can have a different design, such that the platform is for example apt for vehicles etc. to drive upon and the base elements are suitable to be placed under a barrier structure. By connecting the two base elements by the platform, the gate can form a continuous whole which is strong and solid.

The gate preferably comprises at least one post for holding at least one said gate element. Posts are very suitable for holding one or more gate elements in such a way that a said gate element is movable with respect to the post. For example a gate element can be easily hingedly attached to a post.

Further preferably, if the gate comprises a said platform, the post rests upon the platform.

Also preferably, when the gate comprises at least one said front element, the post is attached to the at least one front element, such that forces acting upon the post can be absorbed by the front element and the base element. If forces are exerted directly or indirectly upon the post, for example if a vehicle crashes into one or several gate elements attached to the post, these forces are then guided through the front element and thus towards the base element and thus also towards the barrier structure such that these forces are well absorbed and the security barrier can withstand great forces.

The gate further preferably comprises a support bar for supporting the post. This support bar can for example be a bar that connects an upper zone of the post to the platform, at a distance from the post.

In a preferred embodiment the barrier structure comprises one or more side panels connected to the one or more bottom panels, wherein in installed state of the security barrier a said side panel is connected to the gate. The connection between the barrier structure and the gate is here strong, such that the security barrier can withstand great forces. When the gate comprises for example a said post, then the said side panel is preferably connected to the said post.

The object may also be achieved by providing a gate, for a security barrier comprising at least one barrier structure with one or more bottom panels, wherein the gate forms a closable passage through the security barrier and comprises at least one base element, wherein in installed state of the security barrier the at least one base element is provided to be located underneath one or more bottom panels of the barrier structure, such that the gate is at least partly held in place by the barrier structure. This gate is then preferably a gate for a security barrier as described above. All the advantages described above for the gate of this security barrier and for its preferred embodiments also apply for this gate.

BRIEF DESCRIPTION OF THE DRAWINGS

The present invention is now explained in greater detail below with reference to the following detailed description of some preferred embodiments of a gate and a security barrier assembly according to the present invention. The aim of this description is solely to give illustrative examples and indicate further advantages and particularities and thus cannot be interpreted as a limitation of the field of application of the invention or of the patent rights claimed in the claims.

In this detailed description, reference is made by means of reference numerals to the appended drawings, wherein.

DETAILED DESCRIPTION

Figure 1:
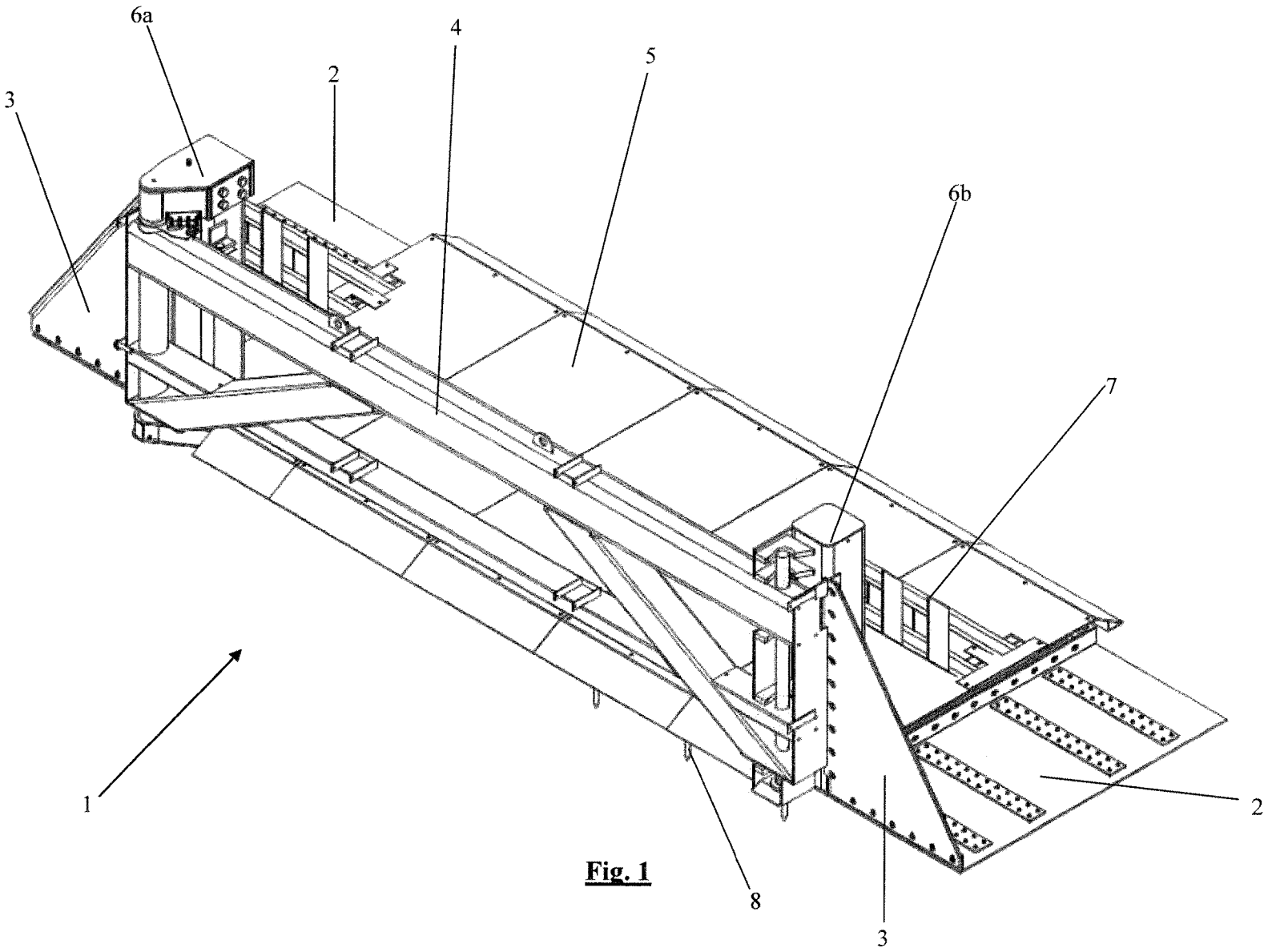
FIG. 1 is a perspective view of a gate according to a first embodiment of the invention.
Figure 2:
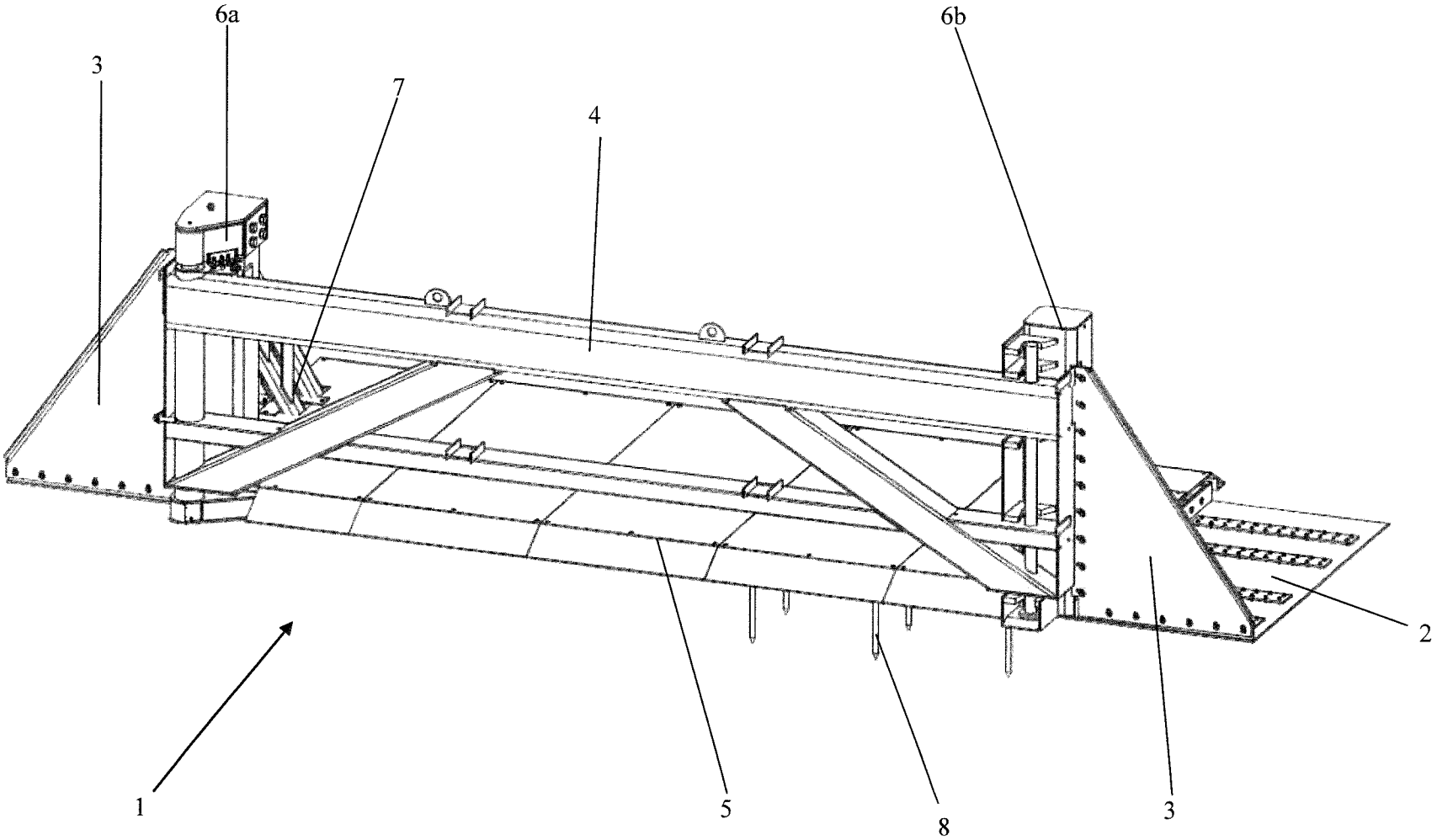
FIG. 2 is a different perspective view of the gate shown in FIG. 1.
Figure 3:
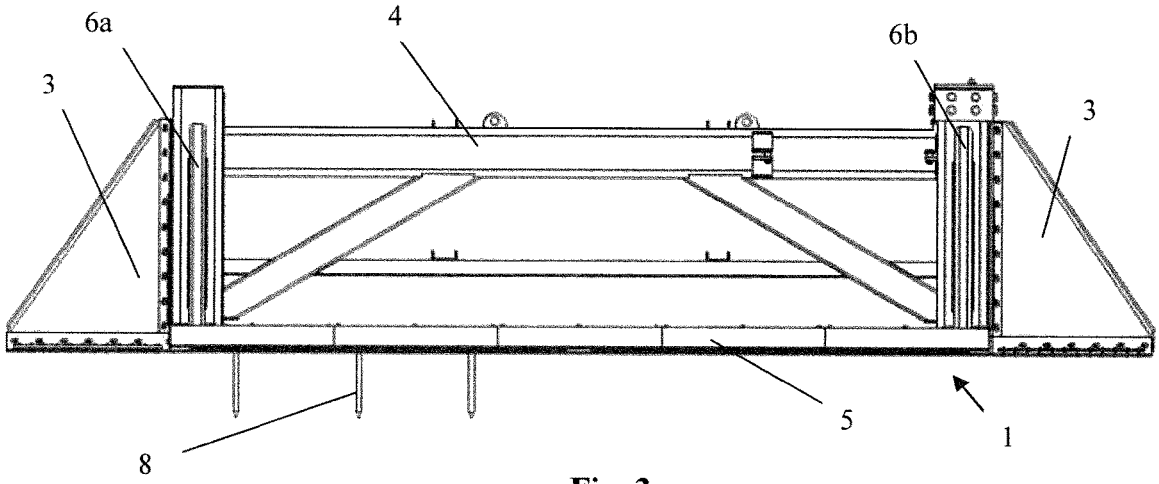
FIG. 3 is a front view of the gate shown in FIGS. 1 and 2.
Figure 4:
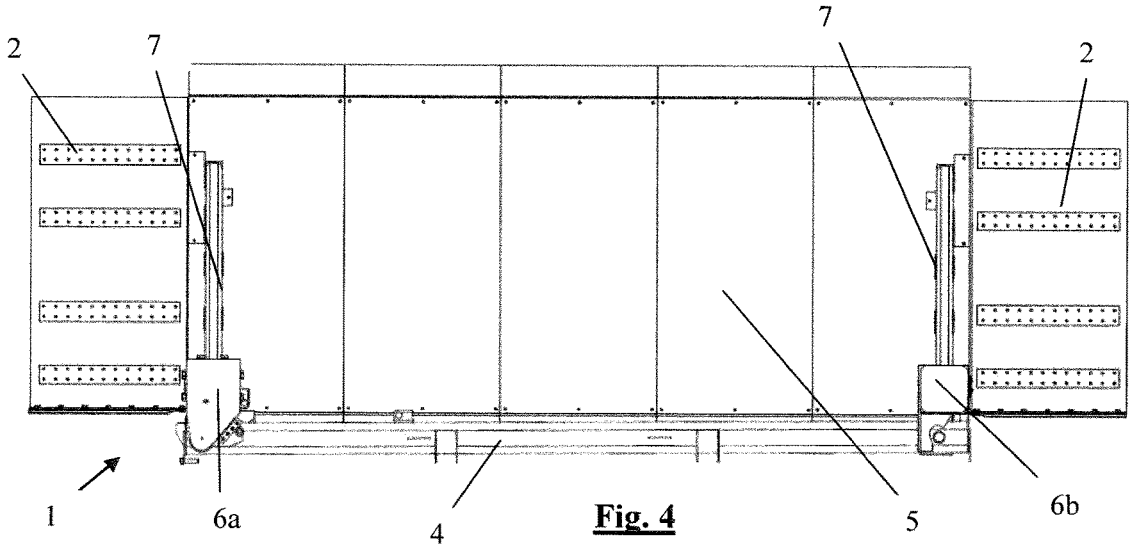
FIG. 4 is a top view of the gate shown in FIGS. 1 to 3.
Figure 5:
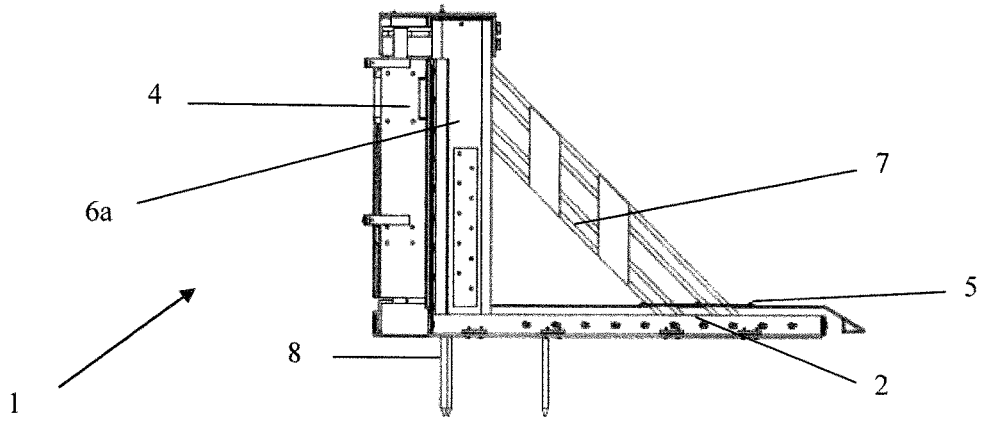
FIG. 5 is a side view of the gate shown in FIGS. 1 to 4.
Figure 6:
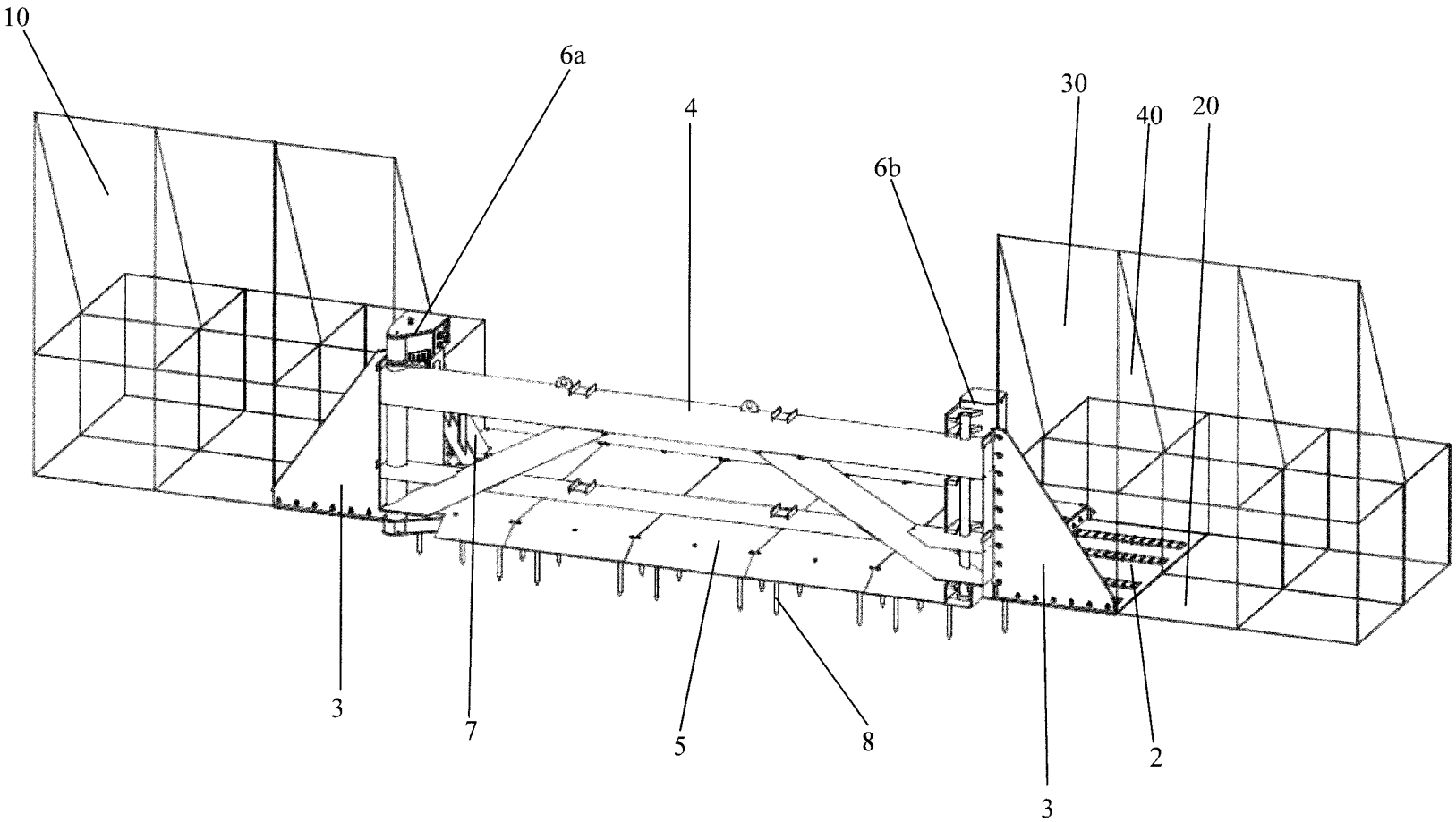
FIG. 6 is a perspective view of a security barrier according to the invention comprising a gate as shown in FIGS. 1 to 5.
Figure 7:
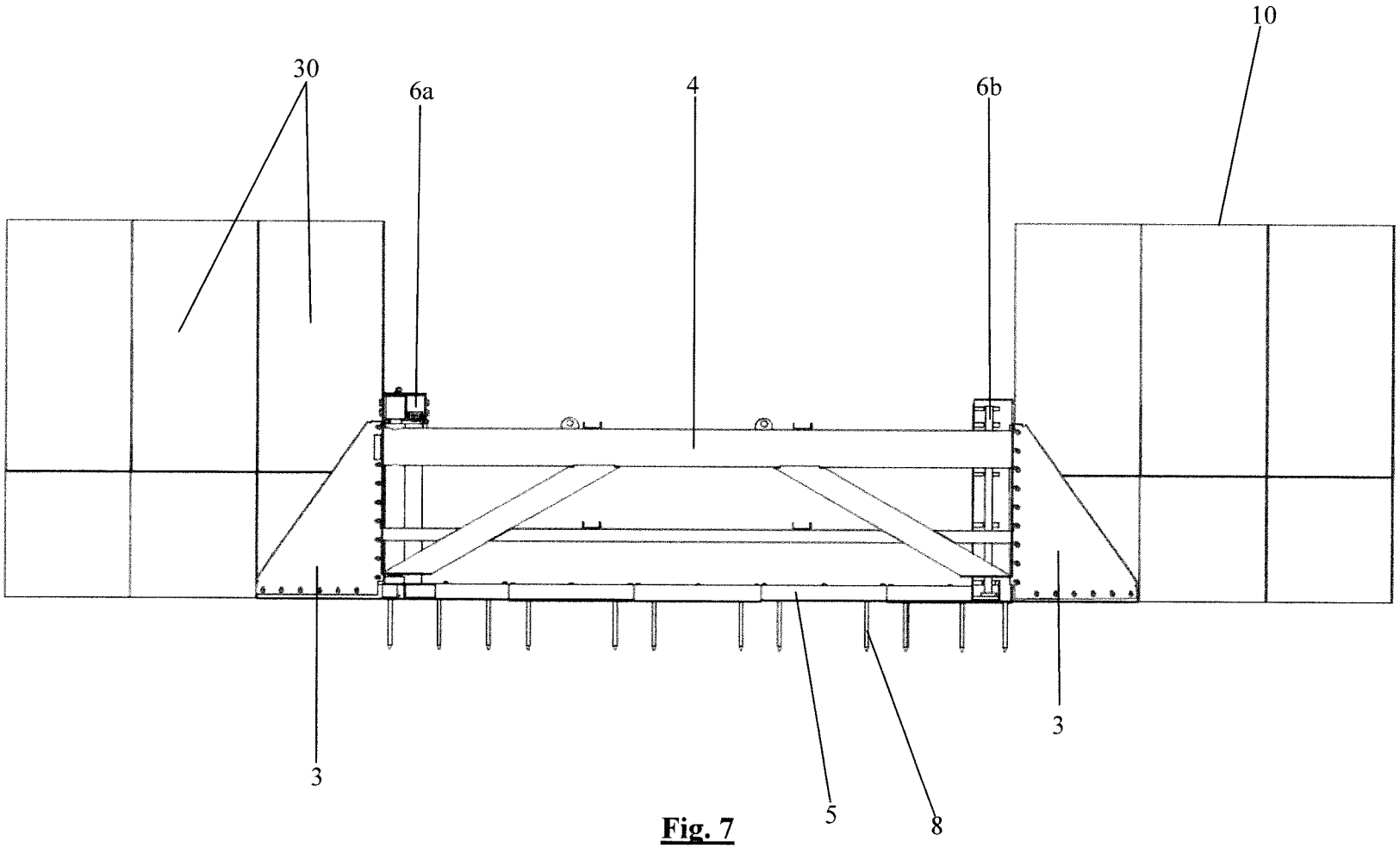
FIG. 7 is a front view of the security barrier shown in FIG. 6.
Figure 8:
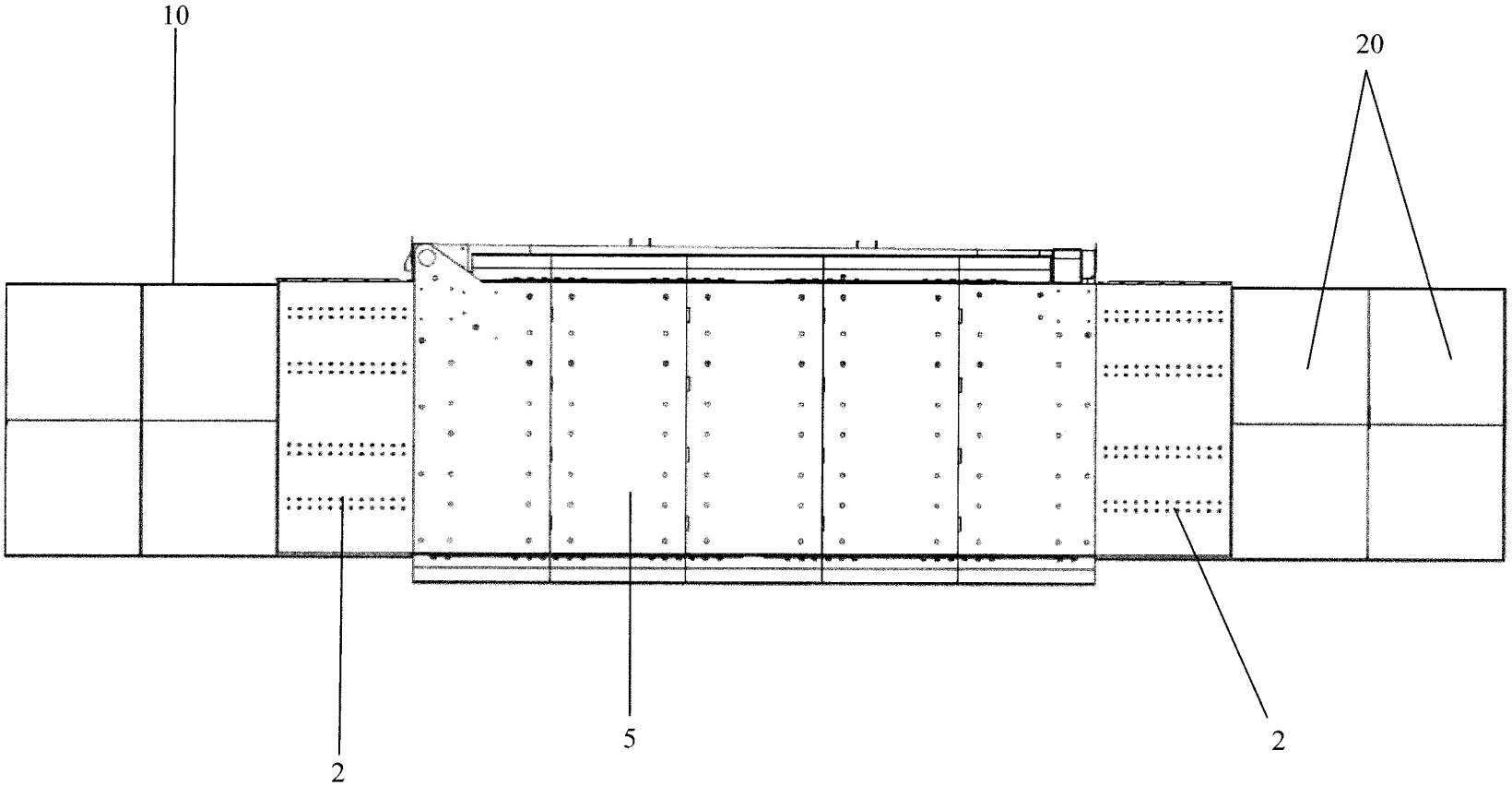
FIG. 8 is a bottom view of the security barrier shown in FIGS. 6 to 7.
Figure 9:
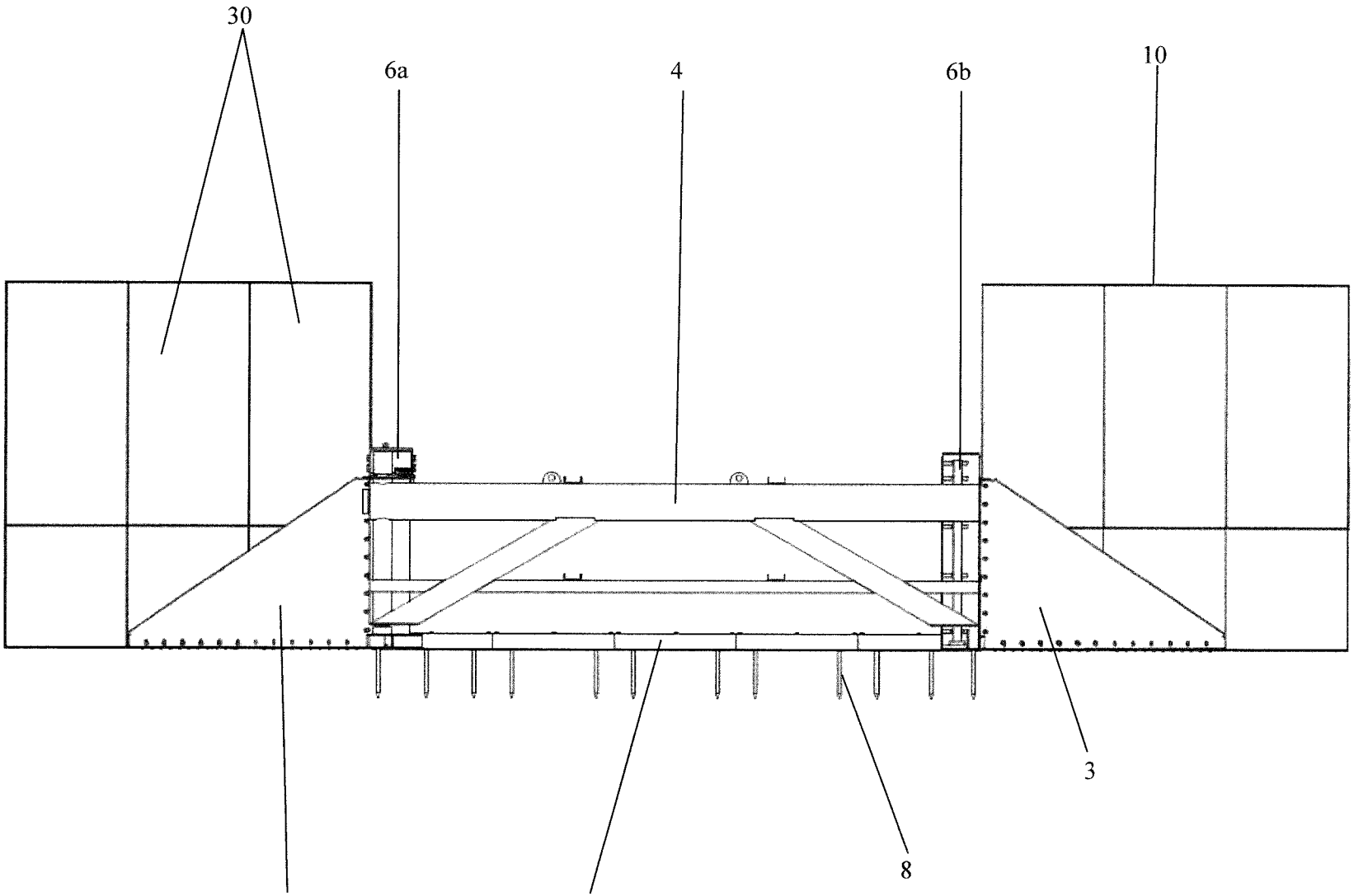
FIG. 9 is a front view of a security barrier according to a second embodiment of the invention comprising a gate according to a second embodiment of the invention.
Figure 10:
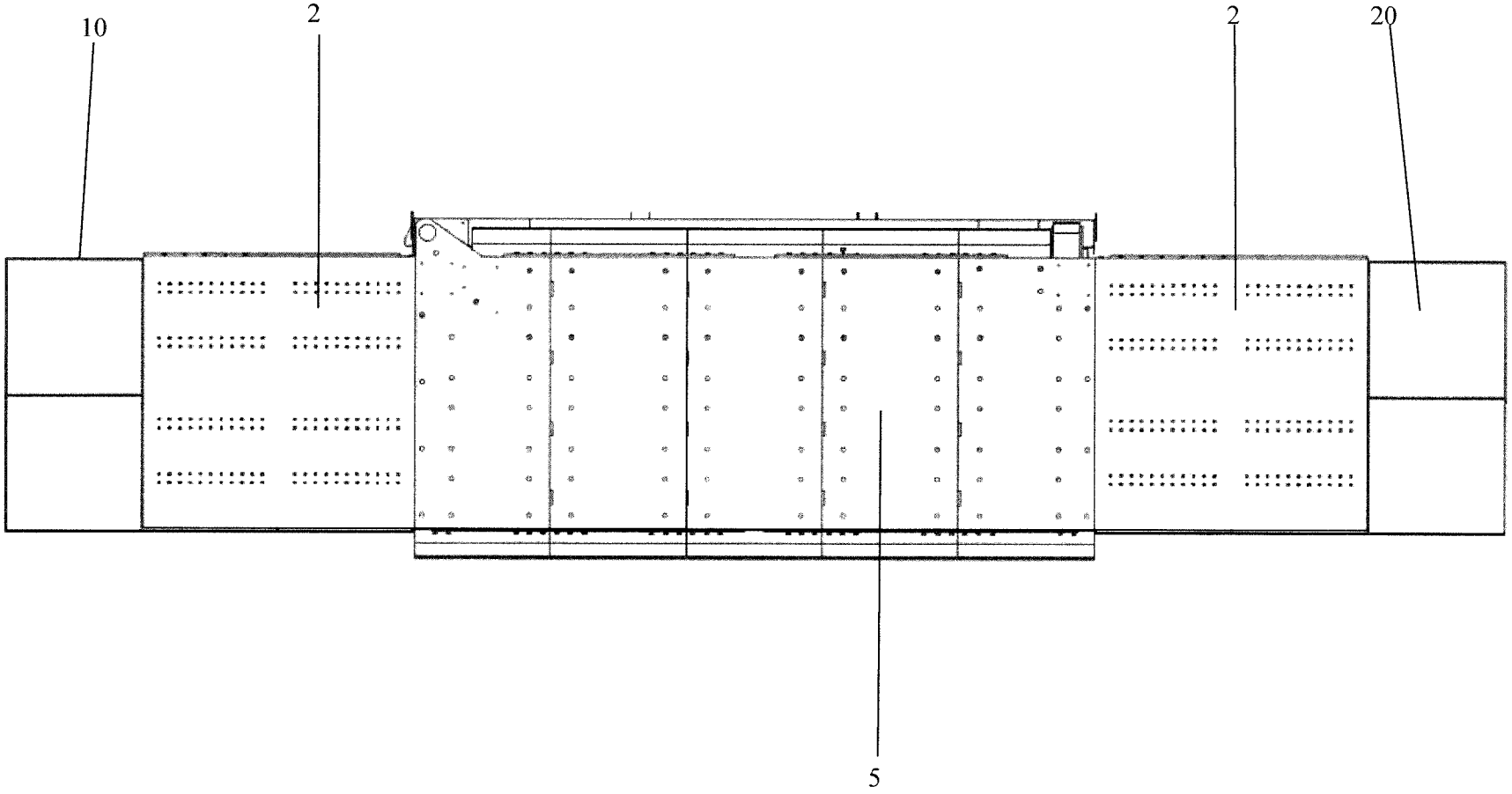
FIG. 10 is a bottom view of the security barrier shown in FIG. 9.

FIGS. 1 to 5 show an embodiment of a gate (1) according to the invention. Other embodiments are of course also possible. FIGS. 6 to 8 show figures where this gate (1) is attached to barrier structures (10), as such forming a security barrier wherein the gate (1) forms a closable passage through the security barrier. FIGS. 9 and 10 show a second embodiment of a security barrier according to the invention.

The security barrier comprises several barrier structures (10) and several gates (1). For each gate (1) there are at least two barrier structures (10) located on both sides of the gate (1), in installed state of the security barrier.

The barrier structure (10) comprises several front panels (30), several bottom panel (20) and several side panels (40). All these panels (20, 30, 40) are mesh panels. In installed state of the security barrier, these panels (20, 30, 40) are connected to each other and the front panels (30) extend vertically and the bottom panels (20) extend horizontally. Weight can be placed upon the bottom panels (20) to hold the barrier structure (10) in the desired position and give the barrier structure (10) enough strength to withstand and absorb impact forces exerted on it.

The gate (1), see FIGS. 1 to 5, comprises:

- two base elements (2) wherein these base elements are bottom plates (2);
- two front elements (3) wherein these front elements are front plates (3), which are each connected at an angle of approximately 90° to a respective bottom plate (2);
- a platform (5) connecting the two bottom plates (2) with each other;
- two posts (6*a*, 6*b*) resting upon the platform (5) and each connected to a respective front plate (3);
- a gate element (4) hingedly connected to a first post (6*a*) of the said two posts (6*a*, 6*b*) and releasable connected to a second post (6*b*) of the said two posts (6*a*, 6*b*);
- Two support bars (7) each connecting an upper zone of a respective post (6*a*, 6*b*) to the platform (5) at a certain distance from the said post (6*a*, 6*b*);
- Several pillars (8) connected to the underside of the platform (5).

The difference between the gate (1) shown in FIGS. 1 to 8 and the gate (1) shown in FIGS. 9 to 10, is that the bottom plates (2) and the front plates (3) in FIGS. 9 to 10 are larger than the bottom plates (2) and the front plates (3) in FIGS. 1 to 8. The gate (1) shown in FIGS. 9 to 10 can be better held in place because it has a larger surface which can be located beneath the barrier structures (10).

In installed state of the security barrier, the security barrier is placed upon a ground surface. The gate (1) forms a closable passage through the security barrier. For this the gate (1) has two posts (6*a*, 6*b*) and a movable gate element (4) which is movable between an open position leaving the said passage through the security barrier open and a closed position closing off the passage. In the closed position of the passage the gate element (4) is connected to the first post (6*a*) and connected to second post (6*b*). To go to the open position, the connection between the gate element (4) and the second post (6*b*) is released and the gate element (4) is hinged with respect to the first post (6*a*) as such forming the passage between the two posts (6*a*, 6*b*). To facilitate the hinging of the gate element (4), the gate element (4) may comprise a roller/wheel at the opposite side of the hingedly attached side of the gate element (4) in order to support the weight of the gate element (4).

The two bottom plates (2) and the two front plates (3) extend on both sides adjacent to the passage, and in installed state of the security barrier, at least one said bottom panel (20) of each abutting barrier structures (10) rests upon the respective bottom plate (2), such to hold the said bottom plate (2) and thus the gate (1) in the desired position. Said at least one bottom panel (20) is attached to the said bottom plate (2). At least a said front panel (30) of each abutting barrier structure (10) faces the respective front plate (3). And the side panel (20) of each abutting barrier structure (10) closest to the gate (1) is connected to a respective post (6*a*, 6*b*). The posts (6*a*, 6*b*) are also each connected to a respective front plate (3) such that forces acting upon a said post (6*a*, 6*b*) and/or the gate element (4) are well guided through the post (6*a*, 6*b*) towards the respective front plate (3) and thus the respective bottom plate (2).

The front plate (3) has a right-angled triangular shape wherein one straight side is connected to the respective post (6*a*, 6*b*) and has approximately the same length as the height of said post (6*a*, 6*b*), while the other straight side is connected to the bottom plate (2). The bottom plate (2) has a rectangular shape. In the installed state of the security barrier, the bottom plate (2) leans completely against a said respective bottom panel (20) and the front plate (3) leans completely against said respective front panel (30).

Further the platform (5) connects the two bottom plates (2) and the platform (5) is suitable for vehicles to drive upon. The posts (6*a*, 6*b*) rest upon the said platform (5) and are each additionally supported by support bars (7) which each additionally connect a said respective post (6*a*, 6*b*) to the platform (5).

The security barrier is provided to be placed upon the ground surface, such that there is no need to deep dig holes to anchor the security barrier. Here the gate (1) comprises small pillars (8), wherein these small pillars (8) are placeable in the ground as such providing additional rigidity to the gate (1). However only small holes need to be dug out to place these pillars (8) in the ground. Charleshray@verizon.net

The invention claimed is:

1. Security barrier comprising at least one barrier structure and at least one gate, wherein the barrier structure comprises one or more bottom panels and the gate forms a closable passage through the security barrier and wherein the gate comprises at least one base element wherein in an installed state of the security barrier one or more of said one or more bottom panels rest upon the at least one base element, such that the gate is at least partly held in place by the barrier structure, the barrier structure comprises one or more front panels connected to the one or more bottom panels, and the gate comprises at least one front element, connected to the at least one base element, wherein in the installed state of the security barrier the at least one front element faces one or more front panels of the barrier structure and wherein the gate comprises at least one post for holding at least one said gate element, wherein the post is attached to the at least one front element, such that forces acting upon the post can be absorbed by the front element and the base element.

2. Security barrier according to claim 1, characterized in that the at least one base element is fixed to a said bottom panel which rests upon the base element in the installed state of the security barrier.

3. Security barrier according to claim 2, characterized in that the at least one base element comprises one or several attaching elements to attach the base element to the said bottom panel.

4. Security barrier according to claim 1, characterized in that the base element comprises a bottom plate, wherein in the installed state of the security barrier the said one or more bottom panels rest upon the bottom plate.

5. Security barrier according to claim 1, characterized in that the front element comprises a front plate.

6. Security barrier according to claim 1, characterized in that the gate comprises one or more movable gate elements which are movable between an open position leaving the said passage through the security barrier open and a closed position closing off the passage.

7. Security barrier according to claim 6, characterized in that the at least part of the base element upon which the said one or more bottom panels rest, substantially extends adjacent to the passage.

8. Security barrier according to claim 7, characterized in the security barrier comprises at least two barrier structures with each one or more bottom panels and located on both sides adjacent to the passage in the installed state of the security barrier.

9. Security barrier according to claim 8, characterized in that the gate comprises at least two base elements, substantially extending on both sides adjacent to the passage, wherein in the installed state of the security barrier one or more of said one or more bottom panels of each barrier structure rest upon a respective base element.

10. Security barrier according to claim 9, characterized in that the gate comprises a platform which connects the two base elements.

11. Security barrier according to claim 10, characterized in that the post rests upon the platform.

12. Security barrier according to claim 1, characterized in that the gate comprises a support bar for supporting the post.

13. Security barrier according to claim 1, characterized in that the barrier structure comprises one or more side panels connected to the one or more bottom panels, and that in the installed state of the security barrier a said side panel (30) is connected to the gate.

14. Gate, for a security barrier comprising at least one barrier structure with one or more bottom panels and with one or more front panels connected to the one or more bottom panels, wherein the gate forms a closable passage through the security barrier and comprises at least one base element, wherein in an installed state of the security barrier the at least one base element is provided to be located underneath one or more bottom panels of the barrier structure, such that the gate is at least partly held in place by the barrier structure, the gate comprises at least one front element, connected to the at least one base element, wherein in the installed state of the security barrier the at least one front element faces one or more front panels of the barrier structure and wherein the gate comprises at least one post for holding at least one said gate element, wherein the post is attached to the at least one front element, such that forces acting upon the post can be absorbed by the front element and the base element.

15. Gate according to claim 14, characterized in that the gate is a gate for a security barrier comprising the at least one barrier structure and the gate, wherein the barrier structure comprises the one or more bottom panels wherein in the installed state of the security barrier one or more of said one or more bottom panels rest upon the at least one base element, and the barrier structure comprises the one or more front panels connected to the one or more bottom panels.

* * * * *